US006642881B1

(12) United States Patent
Lawrence et al.

(10) Patent No.: US 6,642,881 B1
(45) Date of Patent: Nov. 4, 2003

(54) LOW FREQUENCY ELECTROMAGNETIC ABSORPTION SURFACE

(75) Inventors: Christopher R Lawrence, Hampshire (GB); John R Sambles, Exeter (GB); Alistair P Hibbins, Exeter (GB)

(73) Assignee: QinetiQ Limited, Farnborough (GB)

( * ) Notice: Subject to any disclaimer, the term of this patent is extended or adjusted under 35 U.S.C. 154(b) by 0 days.

(21) Appl. No.: 10/049,066

(22) PCT Filed: Aug. 18, 2000

(86) PCT No.: PCT/GB00/03181

§ 371 (c)(1),
(2), (4) Date: Feb. 7, 2002

(87) PCT Pub. No.: WO01/15274

PCT Pub. Date: Mar. 1, 2001

(30) Foreign Application Priority Data

Aug. 25, 1999 (GB) ..... 9920009

(51) Int. Cl.[7] ..... H01Q 17/00
(52) U.S. Cl. ..... 342/4; 342/1
(58) Field of Search ..... 342/1, 2, 3, 4, 342/5–12

(56) References Cited

U.S. PATENT DOCUMENTS

| | | | | |
|---|---|---|---|---|
| 3,713,157 A | * | 1/1973 | August | 342/2 |
| 4,023,174 A | | 5/1977 | Wright | |
| 5,420,588 A | * | 5/1995 | Bushman | 342/2 |
| 5,583,318 A | | 12/1996 | Powell | |
| 5,594,446 A | * | 1/1997 | Vidmar et al. | 342/1 |
| 5,844,518 A | | 12/1998 | Berg et al. | |

FOREIGN PATENT DOCUMENTS

| | | |
|---|---|---|
| EP | 0 397 967 A1 | 11/1990 |
| EP | 0 432 426 A2 | 6/1991 |
| GB | 1 074 851 A | 7/1967 |
| GB | 2 158 995 A | 11/1985 |
| WO | WO 93/23892 A1 | 11/1993 |

OTHER PUBLICATIONS

Seshadri "Adsorption spectra of a dielectric grating on a metal substrate", Journal of the Optical Society of America, vol. 16, No. 4, Apr. 1999, pp. 922–929.

Müller et al., "Plasmon surface polariton coupling with dielectric gratings and the thermal decomposition of these dielectric gratings", Journal of Applied Physics, vol. 82, No. 9, Nov. 1, 1997, pp. 4172–4176.

Hibbins et al, "Grating–coupled surface plasmons at microwave frequencies" Journal of Applied Physics, vol. 86, No. 4, Aug. 15, 1999, pp. 1791–1795.

Hibbins et al, "The coupling of microwave radiation to surface plasmon polaritons and guided modes via dielectric gratings", Journal of Applied Physics, vol. 86, No. 6, Mar. 15, 2000, pp. 2677–2683.

* cited by examiner

*Primary Examiner*—Bernarr E. Gregory
(74) *Attorney, Agent, or Firm*—Nixon & Vanderhye P.C.

(57) ABSTRACT

A radiation absorber comprising a substrate having free charges capable of being driven to form resonance charge density oscillators and a dielectric layer coated onto said surface wherein the dielectric layer has a textured/patterned surface. The substrate is preferably metallic and the dielectric layer is waveform.

9 Claims, 4 Drawing Sheets

LOW FREQUENCY ELECTROMAGNETIC ABSORPTION SURFACE

This application is the US national phase of the international application PCT/GB00/03181 filed Aug. 18, 2000 which designated the U.S.

BACKGROUND OF THE INVENTION

1. Field of the Invention

The invention relates to low-frequency electromagnetic absorption surfaces.

2. Discussion of Prior Art

Surface plasmon polaritons (SPPs) are charge density oscillations induced at the surface of a metal at a metal-dielectric interface when photons are coupled to the mode in the correct manner. The momentum of the incident photons must be boosted if the resonant condition is to be met, and this can be achieved by corrugating the metal to form a diffraction grating. The energy is absorbed by the metal due to damping of the charge density oscillation (i.e. charge collisions lead to heating in the metal), and hence the plasmons cannot convert back to photons for re-emission. In this manner the reflectivity of the metal is reduced when photons are absorbed. This phenomenon is well known at visible frequencies, and forms the basis of many sensor designs.

At microwave frequencies any SPPs that are excited at the surface of the metal will propagate without loss because the charge density oscillations are virtually undamped (i.e. the photon energy cannot be absorbed). Instead of being absorbed, the SPPs will skim the surface until they are converted back to photons at a diffractive feature such as an edge, a curve or the original diffraction grating. Hence the radiation will eventually be re-emitted, and possibly back towards the radiation source. In order to reduce these stray emissions, lossy materials are used as surface coatings to absorb any SPPs that are excited, and methods to prevent the excitation of the modes are sought.

A flat metal plate is a highly efficient microwave reflector that will not normally support SPPS. If it is desired that the plate should absorb all of the energy that fails upon it then absorbing materials are used as surface coatings. Electrically-absorbing materials need to be placed at specific distances from the metal. the shortest of which is a quarter of the wavelength to be absorbed. In the case of magnetic absorbers these are placed directly onto the metal plate. but they are far heavier than electric absorbers. Hence weight and bulk considerations need to be taken into account.

Prior art grating coupling geometry uses a corrugated metal/dielectric interface and when grating coupled in this wax the SPP propagates alone this corrugated boundary. Since the periodic surface may scatter energy associated with the mode into diffracted orders. the propagation length of the mode is reduced. The disadvantage is that complicated profiles cannot easily be made on a metal layer and expensive and complicated techniques of machining metal are required. In addition, the SPP that propagates along the textured surface may only be radiatively damped since the media either side of the boundary are usually non-absorbing.

SUMMARY OF THE INVENTION

It is an object of the invention to provide for a relatively thin, lightweight, broadband absorber, which is relatively simple to fabricate and incorporates a second damping mechanism by which the SPP may decay.

In a first aspect of the present invention, a low frequency, microwave or radar radiation absorber comprises a substrate having free charges and a dielectric layer coated onto said substrate surface, wherein said dielectric layer has a textured patterned surface so configured as to cause absorption of said incident microwave or radar radiation.

Preferably the substrate is metallic. Usually, the substrate is substantially planar and the textured surface is located on the upper surface of the dielectric layer.

Such dielectric gratings (wax) placed onto the metal plate will excite SPPs. The grating can potentially be far thinner than a quarter of a wavelength, and could even be applied in the form of sticky tapes at set spacing. Complicated profiles can easily be carved into soft dielectric (e.g. wax) layers.

In radiation absorbers according to the invention, there are two independent damping process that acts on the SPP as it propagates along the boundary. Firstly, the mechanism that allows radiation to couple into the SPP (i.e. the grating) will also allow the mode to radiatively decay. Secondly, although the top and bottom semi-infinite media (air and metal respectively) are effectively non-absorbing, at these frequencies, this may not be true for dielectrics, such as wax. Since the evanescent fields associated with the SPP mode penetrate the wax, any loss mechanisms within this overlayer will contribute a term to the damping of the mode. Both of these damping terms will contribute to the width of the surface plasmon resonance and will also have a similar effect on any guided modes propagating in the system.

Preferably the dielectric layer is doped with an appropriate absorbing material (e.g. ferrite particles, carbon fibre). In this instance, the SPPs are absorbed by the grating rather than the metal and absorption occurs across a range of wavelengths.

In a second aspect of the present invention, is a method of reducing the low frequency, microwave or radar radiation reflected/ retransmitted from an object comprising the steps of: arranging for the low frequency radiation to be incident on an article comprising a textured/patterned dielectric coated on a substrate having free charges; boosting the momentum of incident photons of the radiation to form surface plasmon polaritons at the substrate/dielectric interface; absorbing the energy of the incident photons by damping mechanisms.

The boosting of the momentum of incident photons occurs due to the textured/patterned surface of the dielectric. The damping mechanisms include a mechanism that allows radiation to couple into the SPP and loss mechanisms within the dielectric layer.

BRIEF DESCRIPTION OF THE DRAWING

The invention will now be described with reference to the following figures of which

DETAILED DISCUSSION OF EMBODIMENTS

Figure 1:
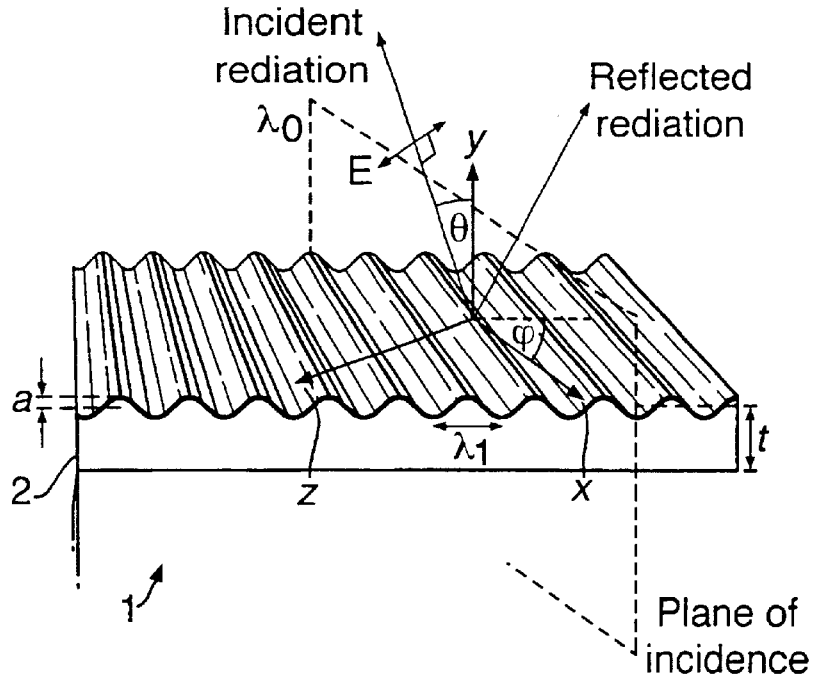
FIG. 1 shows an embodiment of the invention comprising a metal substrate having a dielectric layer of petroleum wax with a profiled surface.

FIG. 1 shows the substrate 1 having a dielectric layer of petroleum wax 2 with a profiled surface. This profile is corrugated (sinusoidal) and having pitch p, amplitude a, and dielectric thickness t. The sinusoidal top interface profile $A(x)=a \cos 2\Pi x/\lambda g$, where $t \approx 2.6$ mm, $a \approx 1.5$ mm and $\lambda g \approx 15$ mm.

The sample is prepared by filling a metallic, square tray of side approximately 400 mm and depth 5 mm with hot wax and allowing it to cool. A metallic "comb" of the desired sinusoidal interface profile is manufactured using a computer-aided design and manufacture technique. It is used to remove unwanted wax from the sample by carefully dragging it across the surface until the required grating profile is obtained.

Figure 2:
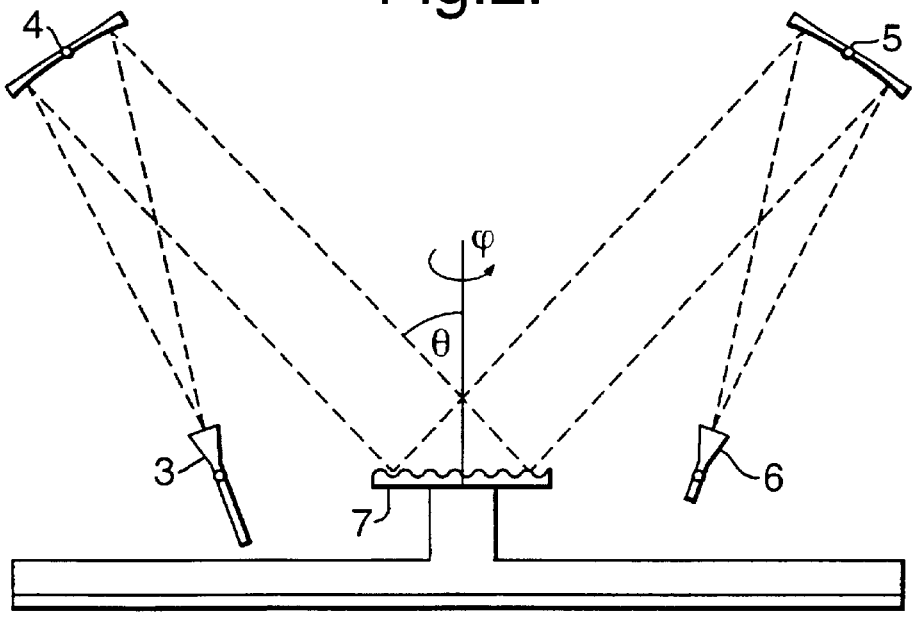
FIG. 2 shows an arrangement used to record reflectivity from the sample.

FIG. 2 shows an arrangement used to record reflectivity from the sample. A transmitting horn 3 is placed at the focus of a 2 m focal length mirror 4 to collimate the beam therefrom. A second mirror 5 is positioned to collect the specularly reflected beam from the grating and focus it at the detector 6. The dielectric grating on the metallic substrate is show designated together by reference numeral 7. Variation of the magnitude of the incident wave—vector in the plane of the grating may be achieved by scanning either wavelength ($\lambda$) or the angle of incidence ($\theta$, $\phi$). The reflectivity data is recorded as a function of wavelength between 7.5 and 11 mm, and over the azimuthal angle ($\phi$) range from 0° to 90° at a fixed polar angle of incidence, $\theta \approx 47°$. The source and receiving horn antennae are set to pass either p-(transverse magnetic, TM), or s-(transverse electric, TE) polarizations, defined with respect to the plane of incidence. This enables the measurement of $R_{pp}$, $R_{ps}$, $R_{ss}$ and $R_{sp}$ reflectivities. The resulting wavelength- and angle-dependent reflectivities from the sample are normalised by comparison with the reflected signal from a flat metal plate.

Figure 3A:
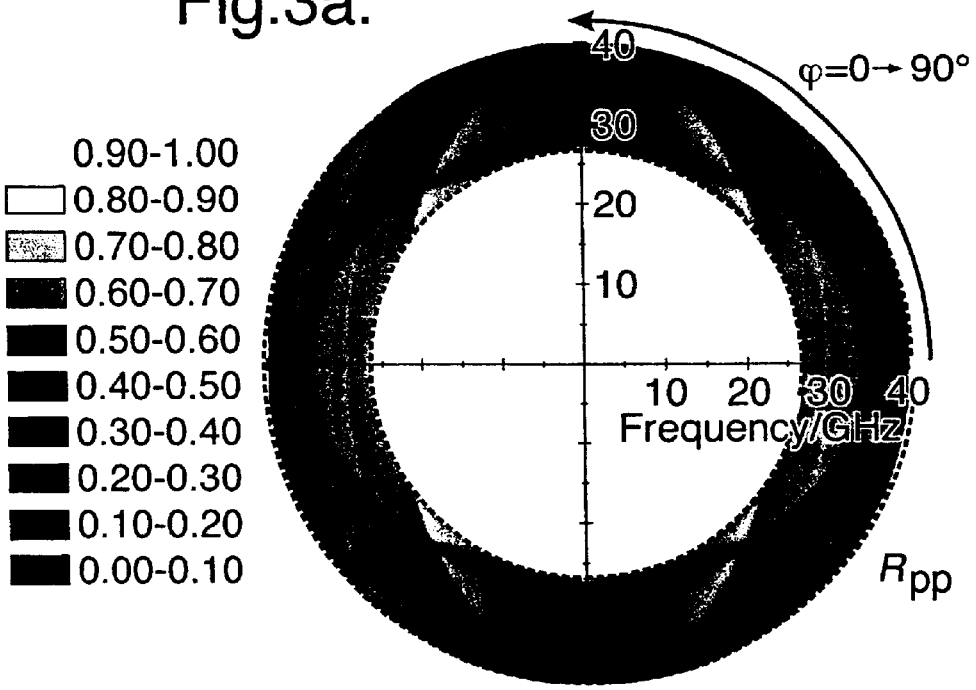
FIGS. 3*a*–3*c* illustrate a polar grey-scale map of the normalised $R_{pp}$, $R_{ps}$, and $R_{ss}$ signals from the sample as a function of frequency and azimuthal angle of incidence.
Figure 3B:
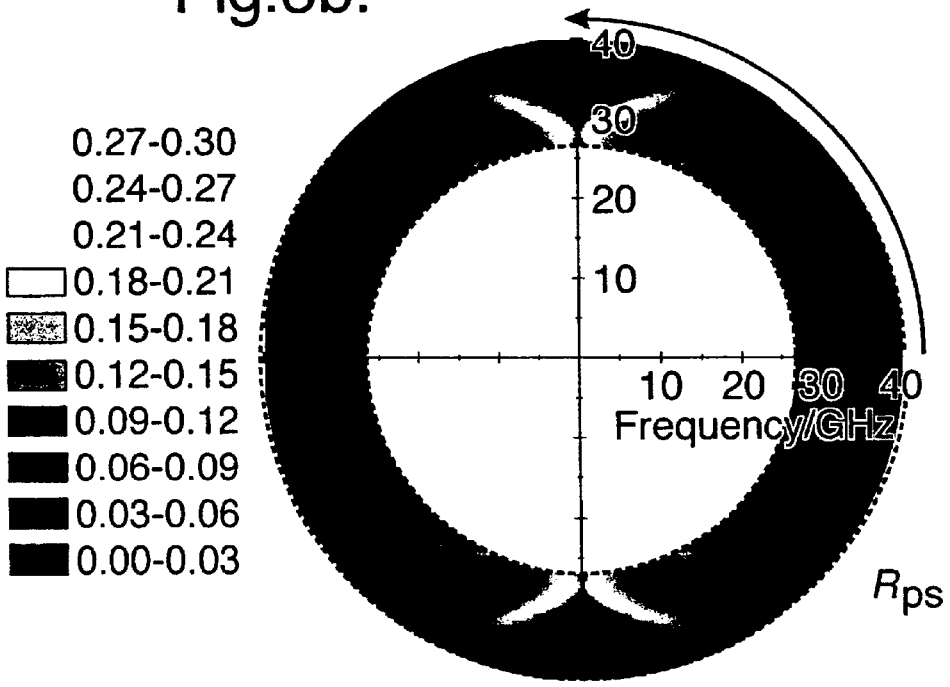
Figure 3C:
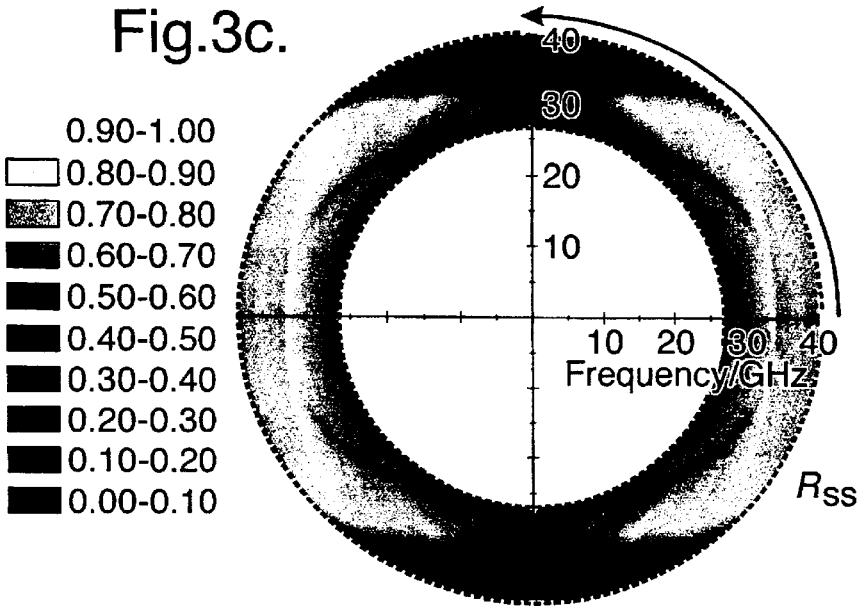
Figure 4A:
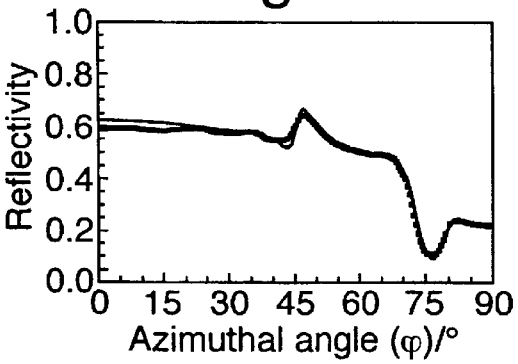
FIGS. 4*a* through 6 are graphical data used to describe the invention.
Figure 4B:
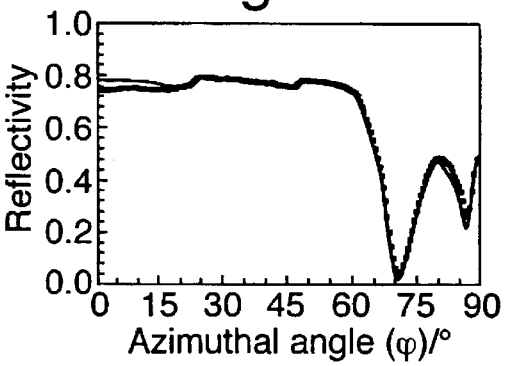
Figure 4C:
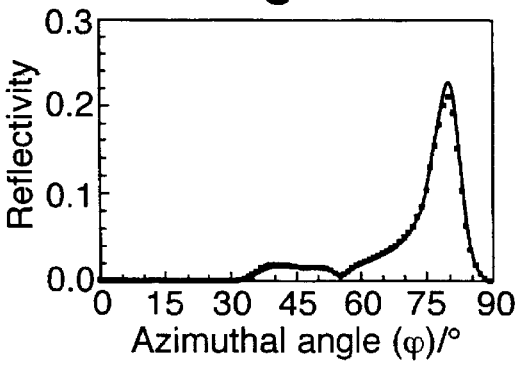
Figure 4B:
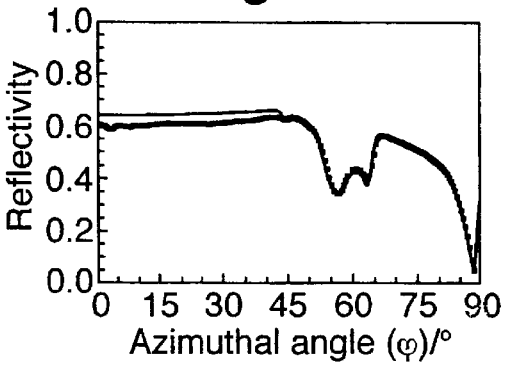

FIGS. 3*a*–3*c* illustrate a polar grey-scale map of the normalised $R_{pp}$, $R_{ps}$, and $R_{ss}$ signals from the sample as a function of frequency and azimuthal angle of incidence. Since the profile of the grating is non-blazed, the results from the two polarisation conversion scans are identical, and hence we do not illustrate the $R_{sp}$ response.

FIGS. 4*a*–4*d* show a series of experimental data sets of reflectivity against azimuthal angle ( ) at wavelengths of (a) 7.5 mm. (b) 8.5 mm, (c) 9.5 mm and (d) 10.5 mm, showing the $R_{pp}$, $R_{ss}$, $R_{ps}$ and $R_{ss}$ signals respectively.

Figure 5:
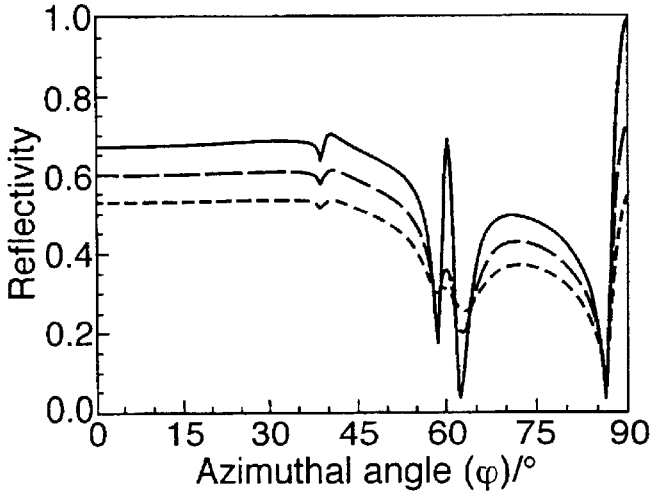
Figure 6:
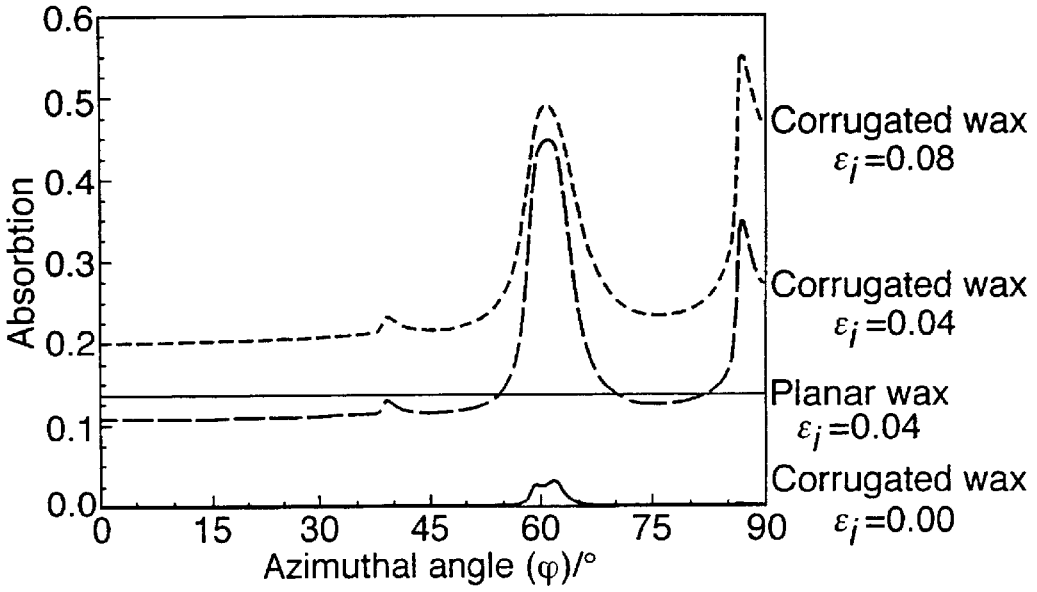

FIGS. 5 and 6 illustrate the effect of the imaginary part of the permittivity of the dielectric layer on the modelled $R_{ss}$ response and degree of absorption of the sample at 11 mm wavelength.

Variables of frequency, dielectric thickness and profile shape can be selected to control the coupling strength (of the incident radiation to the surface plasmon). The corrugated air-dielectric boundary excites diffracted orders which provide the required enhanced momentum to couple radiation to the SPP associated with the wax interface The diffracted SPP (TM) modes propagate along the metal-wax interface. Note that the coupling strength to the SPP decreases to zero as $\phi=0°$ is approached. This is because the incident TE field has no component of electric field acting perpendicular to the grating surface and hence cannot create the necessary surface charge. In other words, the excitation of the modes is polarisation dependent in the case of the single-period textured surface.

The evanescent fields associated with the SPP will sample the wax layer and will penetrate into the air half-space. Therefore, the dispersion of the SPP will be dependent on an effective refractive index ($n^{eff}_{wax}$) since the degree of penetration into the air is governed by the thickness of the wax overlayer. In addition the excitation of guided modes within the dielectric layer also becomes possible where. in contrast to the SPP, the dispersion of these modes is governed by the true refractive index of the layer, $n_{wax}$, where $n_{air}k_o<k_{GM}<n_{wax}k_o$. In a similar manner to the SPP, the guided mode also moves away from the pseudo-critical edge as the wax thickness is increased.

FIGS. 4*a*–4*d* show a series of experimental data sets of reflectivity against azimuthal angle ( ) at wavelengths of (a) 7.5 mm, (b) 8.5 mm, (c) 9.5 mm and (d) 10.5 mm, showing the $R_{pp}$, $R_{ss}$, $R_{ps}$ and $R_{ss}$ signals respectively. The solid curves are the theoretical fits, which are in good agreement with the experimental data. During the fitting process, the amplitude of the corrugation, thickness and real part of the permittivity of the wax, and the polar angle of incidence are all allowed to vary from their measured values. The imaginary part of the permittivity of the wax is initially assumed to be zero, the pitch of the grating is $\lambda g=15$ mm and the permittivities of the metal and air are assumed to be $\epsilon_{metal}=-10^6+10^6 i$ and $\epsilon_{air}=1.0+0.0i$ respectively. Distortion of the grating profile ($a_2$, $a_3$) is also introduced, however it does not improve the average quality of the fits.

A surface according to the invention provides a radar absorbing material for stealth applications, and with commercial applications in areas such as automotive and airport radar control. In prior art absorbers described a sufficiently large grating depth is required to shorten the lifetime of the mode and sufficiently widen the resonance so that it may be easily observed. Using a corrugated dielectric overlayer with non-zero $\epsilon_i$ deposited on a planar metal surface, a second damping mechanism by which the SPP may decay is introduced and the need for such large corrugation amplitudes is decreased.

FIGS. 5 and 6 illustrate the effect of the imaginary part of the permittivity of the dielectric layer on the modelled $R_{ss}$ response and degree of absorption of the sample at 11 mm wavelength. This shows the position of the modes in momentum-space does not change, but the width of these resonances is increased. In addition an absorbing overlayer will decrease the coupling strength to the SPP since the magnitude of the evanescent fields at the metal surface will be reduced. The introduction of absorption in the dielectric decreases the background reflectivity level, however the degree of absorption on-resonance of a well-coupled mode is greatly enhanced. FIG. 6 also illustrates the degree of absorption on a planar sample of the same mean thickness.

It would be understood that the dielectric profiled surface may be provided in alternative ways. The profile is preferably waveformed which includes sinusoidal, saw-tooth, triangular or rectangular wave forms. The amplitude and pitch of the grating would be geared according to the wavelengths to be absorbed, but would probably be between 0.5 and 2.0 times the appropriate wavelength. As far as the thickness of the profile, it is preferably less than a quarter of a wavelength.

The profiled dielectric layer may comprise parallel strips of suitable thin tape material. This embodiment has the advantage that the dielectric layer can be simply applied to existing surfaces.

Other variations include the dielectric layer having a checker board pattern. The advantage of this arrangement is that it provides for a regular pattern in two perpendicular axes on the plane in the surface.

The grating may alternatively comprise a hexagonal mesh of 'dots' or any other geometry. The advantage in higher symmetry groups is that they give a reduction in azimuthal and polarisation sensitivity. The repeat period could be single, multiple or variable to ensure broadband operation, and the entire surface could be 'capped' with a dielectric of a different permittivity to form a protective top-coat that presents a planar uppermost surface.

What is claimed is:

1. A microwave or radar radiation absorber comprising:

a substrate having a surface layer, said surface layer having free charges; and a dielectric layer coated onto said substrate surface, said dielectric layer having a profiled surface for absorbing incident microwave or radar radiation, said free charges forming resonance charge density oscillators.

2. A radiation absorber as claimed in claim 1 wherein said substrate is a substantially planar metallic substrate and said profiled surface is located on an upper surface of the dielectric layer.

3. A radiation absorber as claimed in claim 1 wherein the profiled surface is waveform.

4. A radiation absorber as claimed in claim 1 wherein the dielectric layer comprises a plurality of tape strips.

5. A radiation absorber as claimed in claim 1 wherein said dielectric layer has symmetry in at least two axes over the surface.

6. A radiation absorber as claimed in claim 1 wherein said dielectric material includes doping agents.

7. A radiation absorber as claimed in claim 1 further comprising a further coating over the dielectric layer of different dielectric constant.

8. A method of reducing radiation from an object by using a radiation absorber as claimed in claim 1.

9. A method of reducing microwave or radar radiation from an object comprising the steps of:

arranging for the radiation to be incident on an article when said article includes a profiled dielectric coated on a substrate having free charges;

boosting the momentum of incident photons of said radiation to form surface plasmon polaritons at the substrate/dielectric interface; and absorbing the energy of the incident photons by damping mechanisms.

* * * * *